United States Patent [19]

Hampel

[11] Patent Number: 4,768,265

[45] Date of Patent: Sep. 6, 1988

[54] APPARATUS FOR STRAIGHTENING OF WEFT THREADS IN TEXTILE FABRIC

[75] Inventor: Roland Hampel, Ubach-Palenberg, Fed. Rep. of Germany

[73] Assignee: H. Krantz GmbH & Co., Aachen, Fed. Rep. of Germany

[21] Appl. No.: 80,765

[22] Filed: Aug. 3, 1987

[30] Foreign Application Priority Data

Sep. 10, 1986 [DE] Fed. Rep. of Germany ..... 3630764

[51] Int. Cl.[4] ..... D06H 3/12

[52] U.S. Cl. ..... 26/51.3

[58] Field of Search ..... 26/51.3, 51.4, 51.5, 26/85, 99, 100; 226/191; 29/117

[56] References Cited

U.S. PATENT DOCUMENTS 3,831,828 8/1974 Royon et al. ..... 26/51.3 X

FOREIGN PATENT DOCUMENTS 476454 5/1929 Fed. Rep. of Germany ..... 26/51.3
41-2756 2/1966 Japan ..... 26/51.3
423600 2/1935 United Kingdom ..... 26/51.3
445733 4/1936 United Kingdom ..... 26/51.3

*Primary Examiner*—Robert R. Mackey
*Attorney, Agent, or Firm*—Arthur B. Colvin

[57] ABSTRACT

Apparatus for straightening distorted weft threads comprising a number of flexible rods (1) which form a roller shell (2) around a shaft (3). In the center of the roller shell (2), the rods (1) are connected articulatedly with a disk (5) disposed on the shaft (3) and are thereby held at a certain diameter in this region. In the region of the sides of the roller shell (2), the rods (1) are hinged via load levers (7) to sleeves (11) displaceable on the shaft (3). Via a driven spindle (15), the position of the sleeves (11) and hence also the form of the roller shell (2) can be changed.

2 Claims, 4 Drawing Sheets

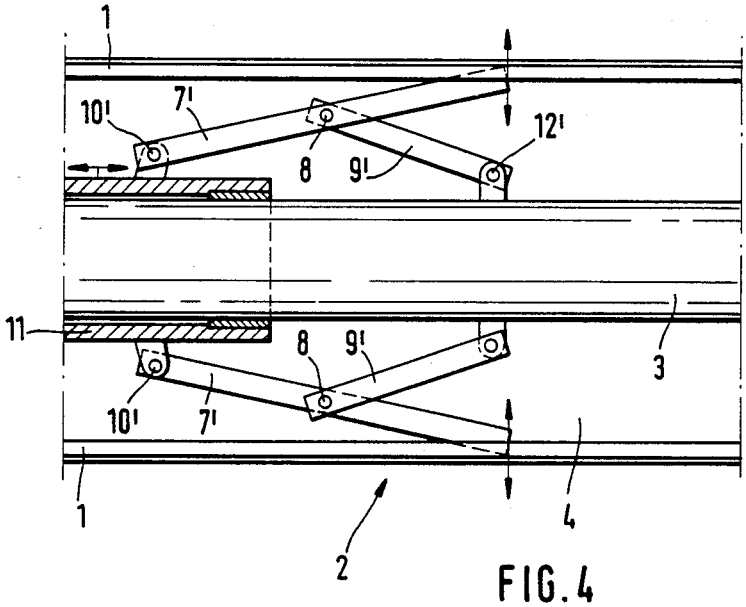
FIG. 4
FIG. 5
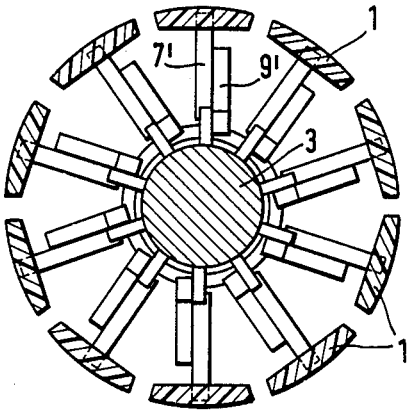

APPARATUS FOR STRAIGHTENING OF WEFT THREADS IN TEXTILE FABRIC

BACKGROUND OF THE INVENTION

1. Field of the Invention

This invention relates to an apparatus for the straightening of weft threads pulled in oblique and/or arcuate distortion in the textile fabric and consists of a number of flexible rods. These form in uniform circular distribution spaced around a shaft, a roller shell. While the rods are held in their center through a disk disposed on the shaft at a constant radial distance from the center axis of the roller shell, the rods are held near their ends at a variable radial distance from the center axis of the roller shell through a sleeve mounted for axial displacement on the shaft.

2. Prior Art

Such an apparatus is known from German Pat. No. DE-PS 525 491. In that apparatus the axial displacement of each sleeve occurs through a handwheel, the hub of which, with female thread, sits on the shaft with male thread in zones.

Apart from the fact that with the known device essentially only symmetrically distorted weft threads can be straightened in the textile fabric, the shell formed by the flexible rods cannot be deformed while the apparatus is in operation. Upon rotation of the handwheel, in fact, the entire roller shell will rotate unless a corresponding counter-moment is exerted, so that axial displacement of the sleeve does not occur and hence there is no deformation of the roller shell. Nor can the necessary counter-moment be supplied by the textile fabric, because the cloth tension normal in the practice is not sufficient for this. Instead, with every attempt at correction, the shell will slip relative to the fabric, and therefore the required distortion of the shell form will not come about and the desired straightening effect will not occur.

Another disadvantage of the known apparatus results from the rigid attachment of the rods in their center. With this method of attachment, the rods must have an especially great elasticity so that they can be deformed to the extent that even considerable weft thread distortions can be straightened. With the elasticity thus required for the rods, there is danger, however, that they will flex too much under the cloth tension, and this, too, has an adverse effect on the straightening action. If, on the other hand, the rods are so rigid that they are not deformed by the web traction, a rigid attachment in the center of the rods leads to an undesired turning point, so that at best obliquely placed S-shaped weft thread distortions can be straightened therewith, but not the usual slantwise distortions.

It is the object of the invention to improve an apparatus of the initially described kind in such a way that the rods forming the roller shell can reliably be brought, during operation, into the required form for the straightening of weft threads pulled in oblique and/or arcuate distortions.

SUMMARY OF THE INVENTION

In accordance with the invention, there is provided a straightening device comprising a shaft having a central disk to the periphery of which a plurality of axially extending flexible rods are pivotally mounted. A pair of sleeves are axially slideably mounted adjacent the ends of the shaft and lever means are interposed between the sleeves and rods.

Due to the fact that according to the invention each rod is articulatedly connected with the disk in the center and also, through a lead lever, with both sleeves in the vicinity of its ends, the rods can be satisfactorily deformed for the straightening of weft threads pulled in oblique distortion as well as in arcuate or partly oblique and partially arcuate distortion, turning points being minimized or avoidable through the articulated connection of the rods with the disk.

Due to the fact further that according to the invention the sleeves are each rotatably but non-axially movably connected to a flange having a threaded nut in which a driven threaded spindle mounted in a thrust bearing of the shaft is guided, the rods can be deformed while the apparatus is in operation without the need for a countermoment to be supplied from the fabric tension.

Preferably the threaded spindle is mounted laterally in the thrust bearing of the shaft and is driven by a chain drive.

According to one form of realization of the invention, the sleeves and the shaft have attached to them a number of radially oriented hinge pins, around which pivot the load or dynamic levers which are cranked radially outward on the sleeve and shaft sides and are provided with pivot bores.

This design results in especially favorable lever length ratios so as to bring about a deformation of the rods by means of slight adjustment forces.

According to another form of realization of the invention, there are pivotable about each radially oriented hinge pin the load or dynamic levers of two diametrically opposite rods forming the roller shell.

By this design the required number of hinge pins can be reduced to one half as compared with a separate correlation of a hinge pin to each load or dynamic lever.

According to another form of realization of the invention, it is further possible to attach, instead of radially oriented hinge pins, a rim of tangentially oriented hinge pins at the sleeves and at the shaft, about which the load or dynamic levers, provided with pivot bores, are pivotable in the manner of umbrella spokes.

BRIEF DESCRIPTION OF THE DRAWINGS

Two embodiment examples of the apparatus of the invention are illustrated in the drawing, in which:

FIG. 4 shows a partial zone of the apparatus in a modified form compared with FIG. 1;

FIG. 5 shows a view of the partial zone per FIG. 4, partly in section.

DETAILED DESCRIPTION OF DRAWINGS

The apparatus consists of a number of flexible rods 1, made for example of plastic. They are arranged at equal distances from each other in a circle in such a way that they form a roller shell 2, if an incomplete one, which in the unbent, stretched state of the rods 1 represents a cylindrical circular cage.

The roller shell 2 is arranged concentric around a shaft 3 so that there remains an annular space 4 between the inside diameter of the roller shell 2 and the outside diameter of the shaft.

Figure 2:
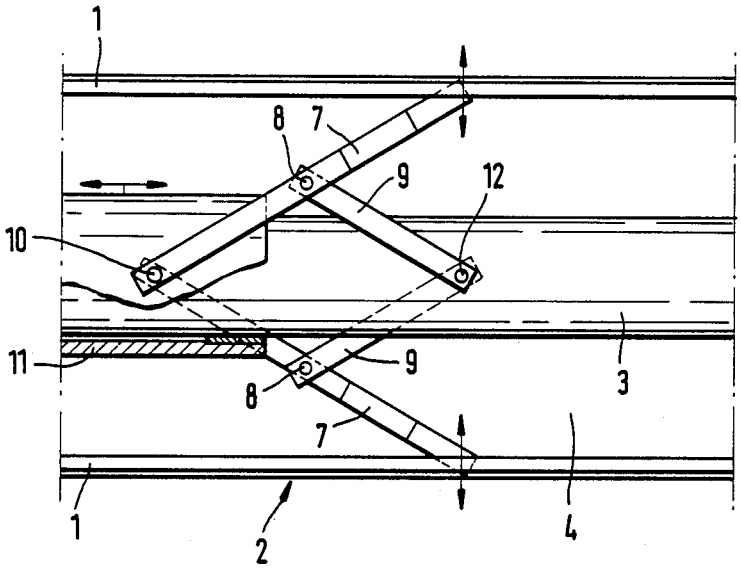
FIG. 2 shows a partial zone of the apparatus per FIG. 1, on a larger scale.
Figure 3:
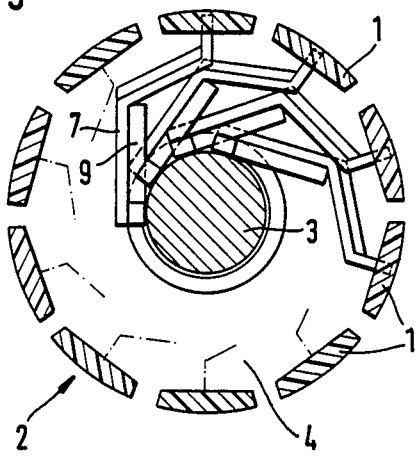
FIG. 3 shows a view of the partial zone per FIG. 2, partly in section.
Figure 6:
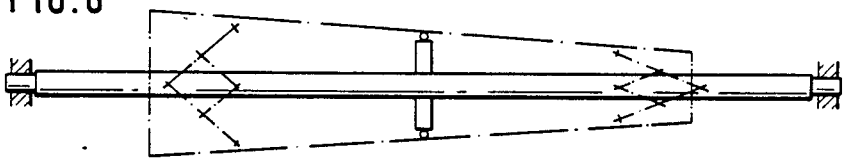
FIGS. 6 to 11 show diagrammatic side views of the apparatus with different states of deformation of the roller shell.
Figure 7:
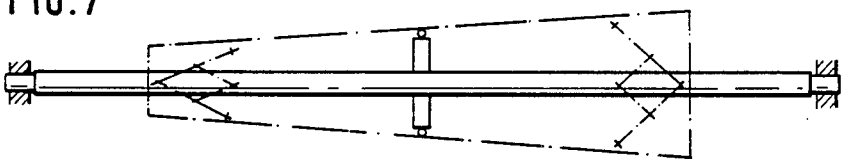
Figure 8:
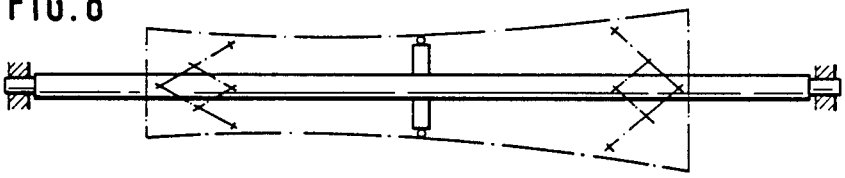
Figure 9:
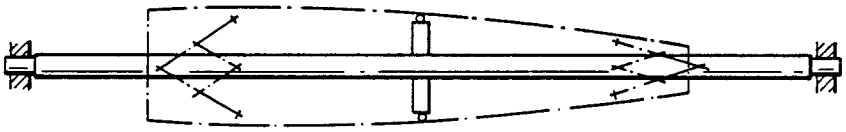
Figure 10:
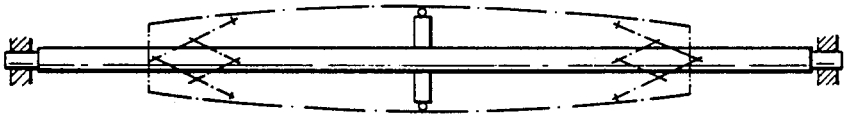
Figure 11:
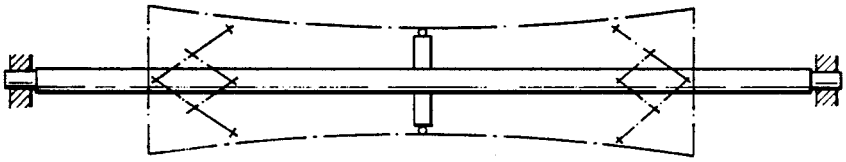

In the center of shaft 3, a disk 5 dividing the annular space 4 is arranged on which the rods 1 are supported through hinges 6. There are, in the two end regions of the annular space 4, cranked load levers 7 (FIGS. 2 and 3) or respectively stretched load levers 7' (FIGS. 4 and 5) as well as likewise cranked dynamic levers 9 or respectively stretched dynamic levers 9' engaging thereon through hinges 8.

The load levers 7, 7' are fastened at one end through a hinge not shown with the rods 1 and with an opposite end through a radially oriented hinge pin 10 (FIG. 2) or respectively through a tangentially oriented hinge pin 10' (FIG. 4) on sleeves 11 axially displaceably mounted on shaft 3.

The dynamic levers 9 and 9' are fastened to shaft 3 at their end opposite hinge 8 through hinge pins 12, 12' arranged radially or tangentially on shaft 3.

Figure 1:
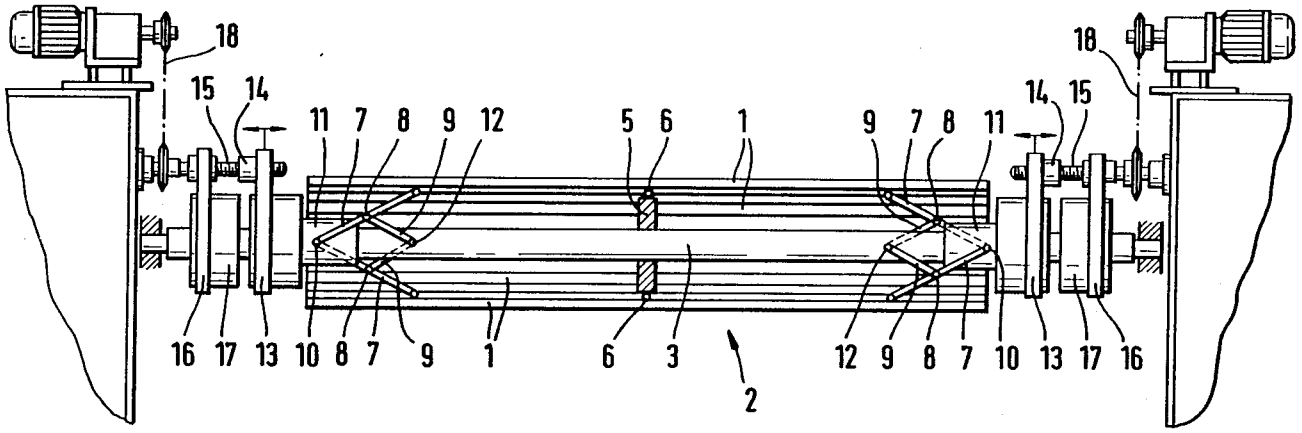
FIG. 1 shows a side view of the apparatus, partially in section.

The two sleeves 11 are rotatably but non-axially shiftably connected, as FIG. 1 shows, with a flange 13 for each, which is provided with a threaded nut 14 in which sits a threaded spindle 15 oriented parallel to the axis of shaft 3. Said spindle is mounted in a bore of a flange 16, which forms part of a thrust bearing 17 disposed on shaft 3.

Each spindle 15 can be driven by a separate chain drive 18 in such a way that the sleeves 11 can occupy different positions independently of each other. This makes it possible to selectively vary the angular position of the dynamic levers 9 and 9' and hence also the angular position of the load levers 7 and 7' in such a way that the elastic rods 1 are deformed and jointly form for example one or the other of the roller contours illustrated in FIGS. 6 to 11.

I claim:

1. Apparatus for straightening the weft threads of textile fabrics comprising a rotatable shaft, a circular disk mounted centrally on said shaft, a plurality of flexible rod members having central portions pivotally mounted at angularly spaced intervals to the periphery of said disk, the distal ends of said rod members being shiftable toward and away from said shaft, a sleeve member axially movably mounted adjacent each end of said shaft, a plurality of lever means pivotably connecting a respective said sleeve with said rod members adjacent said distal ends, each said lever means comprising a first link having its ends pivotally connected respectively to a said sleeve and a said rod member, and a second link having one end pivotally connected to said shaft, and another end pivotally connected to said first link at a position intermediate the ends of said first link, and means for independently shifting said sleeves axially of said shaft whereby said distal ends of said rod members are deflected toward and away from said shaft in accordance with the adjusted position of said sleeves along said shaft.

2. Apparatus for straightening the weft threads of textile fabric comprising a rotatable shaft, a circular disk mounted centrally on said shaft, a plurality of flexible rod members having central portions pivotally mounted at angularly spaced intervals to the periphery of said disk, the distal ends of said rod members being shiftable toward and away from said shaft, a sleeve member axially movably mounted adjacent each end of said shaft, a plurality of lever means pivotally connecting a respective sleeve with said rod members adjacent said distal ends, said lever means comprising a first pair of links each having one end pivotally connected to said sleeve, the other ends of said first links being pivotally connected to a diametrically opposed pair of said rod members, and a second pair of links each having one end pivotally connected to said shaft, the opposite ends of said second pair of links being pivotally connected to said first links at an intermediate position thereof, and means for independently shifting said sleeves axially of said shaft whereby said distal ends of said rod members are deflected toward and away from said shaft in accordance with the adjusted position of said sleeves along said shaft.

* * * * *